US009374881B2

(12) United States Patent
Aoki et al.

(10) Patent No.: US 9,374,881 B2
(45) Date of Patent: Jun. 21, 2016

(54) RADIATION GENERATOR INCLUDING CUT-OFF VOLTAGE GENERATOR AND ASSOCIATED DETECTION UNIT

(71) Applicant: CANON KABUSHIKI KAISHA, Tokyo (JP)

(72) Inventors: Shuji Aoki, Yokohama (JP); Kazuyuki Ueda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 14/089,447

(22) Filed: Nov. 25, 2013

(65) Prior Publication Data

US 2014/0146943 A1 May 29, 2014

(30) Foreign Application Priority Data

Nov. 28, 2012 (JP) ..... 2012-259900

(51) Int. Cl.
*H05G 1/32* (2006.01)
*H05G 1/54* (2006.01)

(52) U.S. Cl.
CPC ..... *H05G 1/54* (2013.01)

(58) Field of Classification Search
CPC ..... H01J 35/00; H01J 35/02; H01J 35/025; H01J 35/04; H01J 35/06; H01J 35/065; H05G 1/00; H05G 1/02; H05G 1/04; H05G 1/06; H05G 1/08; H05G 1/085; H05G 1/10; H05G 1/26; H05G 1/265; H05G 1/30
USPC ..... 378/111, 113, 119, 121, 122
See application file for complete search history.

(56) References Cited

U.S. PATENT DOCUMENTS

| | | | | | |
|---|---|---|---|---|---|
| 3,617,686 | A * | 11/1971 | Dietrich | B23K 15/02 | 219/121.13 |
| 5,008,916 | A * | 4/1991 | Le Guen | H05G 1/04 | 378/118 |
| 2006/0008053 | A1* | 1/2006 | Ishikawa | H05G 1/30 | 378/111 |
| 2006/0165220 | A1* | 7/2006 | Takahashi | H05G 1/10 | 378/109 |
| 2010/0183117 | A1* | 7/2010 | Tsumuraya | A61B 6/405 | 378/9 |
| 2011/0007874 | A1* | 1/2011 | Vogtmeier | H01J 1/3048 | 378/119 |

FOREIGN PATENT DOCUMENTS

| | | | |
|---|---|---|---|
| JP | 61126799 | A | 6/1986 |
| JP | 2000082594 | A | 3/2000 |
| JP | 2007042516 | A | 2/2007 |

* cited by examiner

*Primary Examiner* — Nicole Ippolito
*Assistant Examiner* — Jason McCormack
(74) *Attorney, Agent, or Firm* — Canon USA Inc., IP Division

(57) ABSTRACT

A radiation generator includes: a radiation tube configured to generate radiation by emitting electrons from a cathode through a grid to a target; a grid-voltage generating unit configured to apply an extraction voltage to the grid in response to an external request for radiation output; a cut-off voltage generating unit configured to generate a cut-off voltage applied to the grid so as to lower the potential of the grid relative to the potential of the cathode when there is no external request for the radiation output; and a detection unit configured to detect a decrease in the cut-off voltage, wherein the target is not irradiated by the electrons when the decrease in the cut-off voltage is detected.

9 Claims, 5 Drawing Sheets

RADIATION GENERATOR INCLUDING CUT-OFF VOLTAGE GENERATOR AND ASSOCIATED DETECTION UNIT

BACKGROUND OF THE INVENTION

1. Field of the Invention

The present invention relates to a radiation generator for controlling the output state of radiation.

2. Description of the Related Art

An X-ray generator has an X-ray tube that generates X-rays by emitting electrons from an electron source to a target. The electron source includes a cathode to generate electrons and a grid electrode to adjust the amount of electrons. Electrons passing through the grid are accelerated and made to impinge on the target by an acceleration voltage applied between the electron source and the target.

Japanese Patent Application Laid-Open No. 2007-42516 discloses an X-ray generator that detects a current flowing through a grid to determine the degradation of an X-ray tube.

In a radiation tube represented by an X-ray tube, a cut-off voltage is applied to a grid when the output of the radiation is stopped. If the cut-off voltage is not output as desired, the output of the radiation is not always stopped. In addition, if the output of the cut-off voltage is insufficient, an extraction voltage at the output of the radiation rises higher than a predetermined value depending on a circuit configuration. As a result, an unexpected increase in the amount of electrons emitted from an electron source may damage a target. Damage to the target results in shortening the life of the radiation tube.

SUMMARY OF THE INVENTION

In order to solve the problems above, a radiation generator according to embodiments of the present invention includes:

a radiation tube configured to generate radiation by emitting electrons from a cathode through a grid to a target;

a grid-voltage generating unit configured to apply an extraction voltage to the grid in response to an external request for radiation output;

a cut-off voltage generating unit configured to generate a cut-off voltage applied to the grid so as to lower the potential of the grid relative to the potential of the cathode when there is no external request for the radiation output; and a detection unit configured to detect a decrease in the cut-off voltage, such that the target is not irradiated by the electrons when the decrease in the cut-off voltage is detected.

Further features of the present invention will become apparent from the following description of exemplary embodiments with reference to the attached drawings.

DESCRIPTION OF THE EMBODIMENTS

Embodiments of the present invention will now be described with reference to the drawings.

First Embodiment

Figure 1:
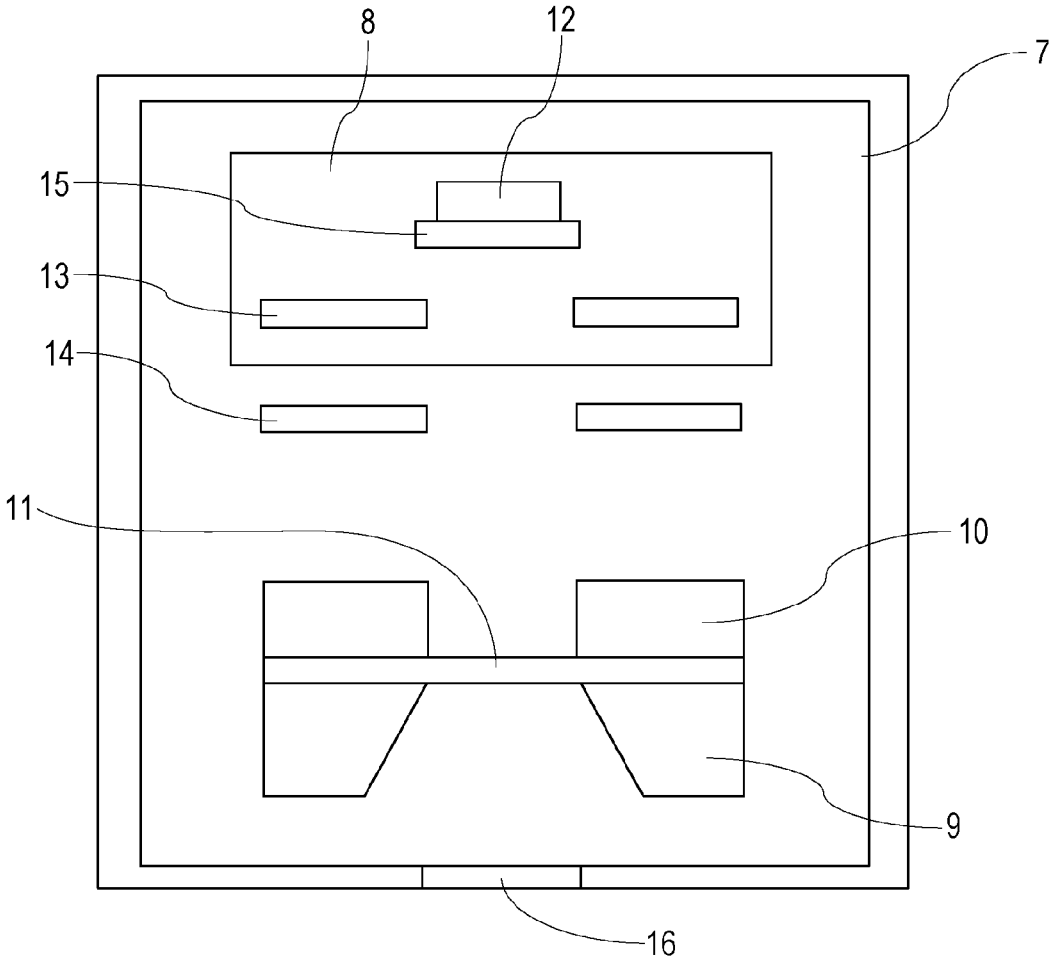
FIG. 1 is a block diagram showing the configuration of a radiation tube according to an embodiment of the present invention.

FIG. 1 is a block diagram showing an exemplary configuration of a radiation tube according to the first present embodiment. As illustrated in FIG. 1, the radiation tube (radiation apparatus), includes an electron source 8, a lens electrode 14, and a transmission type target (hereinafter referred to as a "target") 11 are arranged within a vacuum vessel. The electron source 8 includes a filament 12 to generate heat electrons by heating a cathode 15 to define the potential of an electron emission region, and a grid 13 to extract thermal electrons. Electrons passing through the grid 13 are focused by the lens electrode 14 and are accelerated by an acceleration voltage, and then the target 11 is irradiated by the electrons. The target 11 emits radiation in response to irradiation of the electrons. The acceleration voltage (80-120 kV) is applied between the cathode 15 and the target 11 such that the potential of the target 11 is higher relative to the potential of the cathode 15 (i.e., cathode potential). The electron source 8 can be a cold cathode such as a carbon nanotube or can be a hot cathode such as a tungsten filament or an impregnated cathode. The filament 12 and the cathode 15 are electrically isolated from each other.

The grid 13 is alternatively provided with a cut-off voltage that does not extract electrons from the cathode 15 or an extraction voltage that extracts electrons therefrom. The cut-off voltage is applied to the grid 13 such that the potential of the grid 13 is lower than the cathode potential with reference to the cathode potential. The extraction voltage is applied to the grid such that the potential of the grid 13 is higher than the cathode potential with reference to the cathode potential.

The lens electrode 14 is alternatively provided with a non-focus voltage that does not cause a lens effect or a focus voltage that causes the lens effect. The non-focus voltage is applied to the lens electrode 14 such that the potential of the lens electrode 14 is lower than or equal to the cathode potential. The focus voltage is applied to the lens electrode 14 such that the potential of the lens electrode 14 is higher than the cathode potential.

An anode includes the target 11, and a front shield 9 and a rear shield 10 placed back and forth (on opposite surfaces of the target 11) so as to sandwich the target 11 therebetween. The rear shield 10, which has an opening through which electrons from the electron source 8 pass, shields the radiation emitted by the target 11 from traveling rearward (i.e., toward the electron source 8). The front shield 9, which has an opening through which the radiation passes, shields part of the radiation emitted by the target 11 from traveling forward (i.e., on the opposite side of the electron source 8).

As the target 11, a heavy metal with a high radiation generating efficiency at a high melting point, for example, such as tungsten or tantalum is used. As the vacuum vessel, which serves to keep the inside of a radiation tube 7 at a vacuum of about $10^{-5}$ Pa, glass, metal, or ceramic is used. The radiation tube 7 is provided with a radiation transmission window 16 for emitting radiation to the outside toward a subject.

Figures 2A, 2B, 2C:
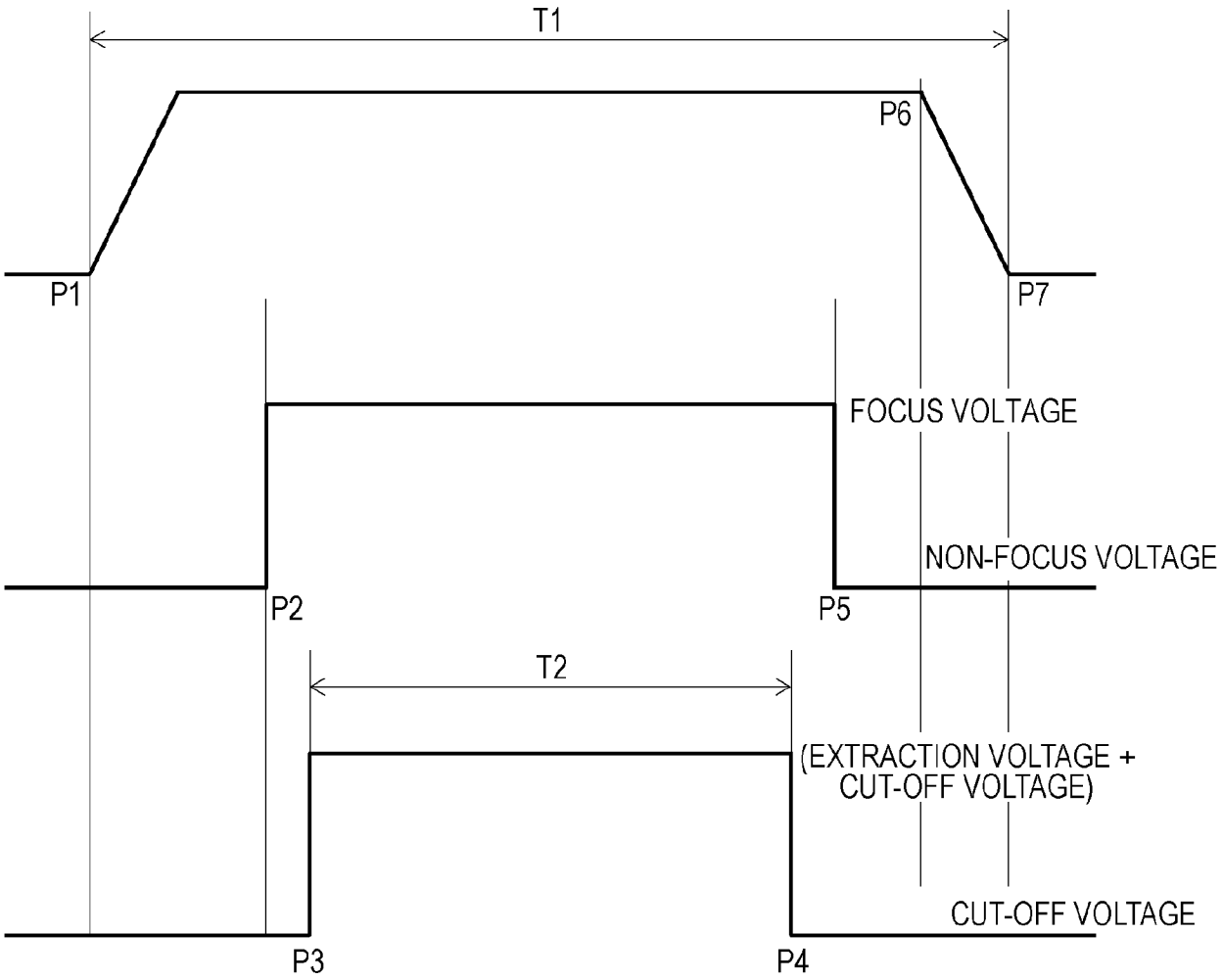
FIGS. 2A, 2B and 2C are waveform diagrams showing control signals applied to the radiation tube.

A control signal applied to the radiation tube 7 will now be described with reference to FIGS. 2A to 2C. A radiation generator according to the present embodiment includes the above-described radiation tube 7 and a control unit 6. The control unit 6 has a power supply circuit 22 and a control circuit 23. In FIGS. 2A to 2C, the abscissa represents time and the ordinate represents voltage. FIG. 2A shows the timing of applying an acceleration voltage (potential of the target 11 relative to the cathode 15). FIG. 2B shows the timing of applying a lens electrode voltage to the lens electrode 14. FIG. 2C shows the timing of applying a grid voltage to the grid 13. The control unit 6 controls the respective timing of applying the acceleration voltage, the lens electrode voltage, and the grid voltage.

The acceleration voltage, the grid voltage, and the lens electrode voltage are set to zero, the cut-off voltage, and the non-focus voltage, respectively, in an initial state (where the radiation generator is instructed to turn on so that the power supply circuit 22 is turned on). Energization of the filament 12 is started before applying the acceleration voltage in order to stably emit thermal electrons, and is stopped after stopping application of the acceleration voltage.

The acceleration voltage starts to be applied at time P1 when transition to a standby state is performed after a predetermined period of time has elapsed from power-on of the power supply circuit 22. The rise and fall of the acceleration voltage provide a delay time. The lens electrode voltage is switched from the non-focus voltage to the focus voltage (i.e., the lens electrode voltage starts to be applied) at time P2 when an external request for radiation output is received in the standby state. The grid voltage is switched from the cut-off voltage to the extraction voltage at time P3 quickly after the lens electrode voltage starts to be applied, so that radiation is emitted.

A period T2 during which the radiation is emitted is set beforehand, and the period T2 is, for example, 10 msec to 4 sec. The grid voltage is switched from the extraction voltage to the cut-off voltage at time P4 when the period T2 ends, and the lens electrode voltage is then switched from the focus voltage to the non-focus voltage at time P5. The output of the acceleration voltage is stopped at time P6 when the radiation generator is instructed to turn off.

Figure 3:
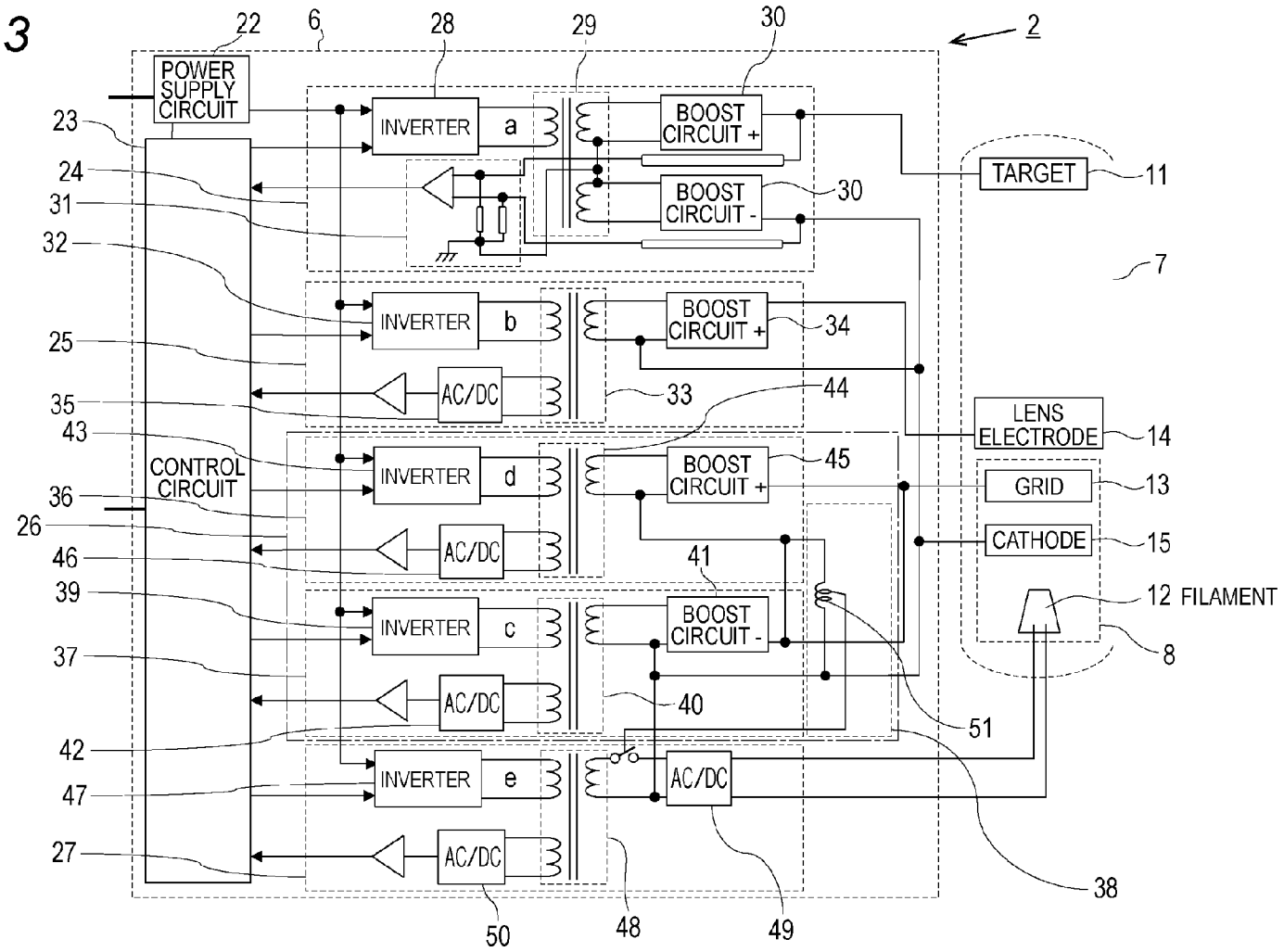
FIG. 3 is a block diagram showing the configuration of a radiation generator according to the embodiment of the present invention.

A radiation generator 2 of the present embodiment will be described with reference to FIG. 3. The control unit 6 includes the power supply circuit 22, the control circuit 23, and control blocks (i.e., a high-voltage generating unit 24, a lens electrode driver 25, a grid driver 26, and a filament driver 27).

The power supply circuit 22 receives power from an external DC power source or an external AC power source, and supplies a desired DC power to the control circuit 23 and the control blocks.

The control circuit 23 outputs control signals to the control blocks in response to an external request for radiation output. The control circuit 23 also receives the following detection signals as feedback signals: a tube voltage detection signal from the high-voltage generating unit 24, a lens electrode voltage detection signal from the lens electrode driver 25, a cut-off voltage detection signal and an extraction voltage detection signal from the grid driver 26, and a filament voltage detection signal from the filament driver 27.

The high-voltage generating unit 24 generates a high voltage of ±50 kV, and applies −50 kV and +50 kV to the cathode 15 and the target 11, respectively. That is, the acceleration voltage is generated by a grounded midpoint type where the midpoint of the cathode 15 and the target 11 is grounded. A high-voltage inverter circuit 28 generates an AC power signal "a" of 20 V to 1 kV at 1-500 kHz in response to a control signal from the control circuit 23. The AC power signal "a" is converted to an acceleration voltage (DC voltage signal) of DC ±50 kV by a high-voltage isolation transformer (transformer circuit) 29 and a boost circuit 30 for generating a high-voltage. The tube voltage detection signal is generated by a tube voltage detection circuit 31 based on the acceleration voltage.

The lens electrode driver 25 generates the lens electrode voltage. An inverter circuit 32 for the lens electrode generates an AC power signal "b" of 10-100 V at 1-500 kHz in response to a control signal from the control circuit 23. The AC power signal "b" is converted to a lens electrode voltage of DC 1-10 kV by an isolation transformer 33 and a boost circuit 34 for the lens electrode. The primary side of the isolation transformer 33 is provided with a primary mirror winding to respond to the secondary side output thereof, and the lens electrode voltage detection signal is generated from the output of the primary mirror winding through a rectifier circuit 35 for detecting the lens electrode voltage.

The grid driver 26 includes a grid-voltage generating unit 36, a cut-off voltage generating unit 37, and a cut-off voltage detecting unit 38. The grid voltage is generated by superimposing the output of the grid-voltage generating unit 36 on the output of the cut-off voltage generating unit 37. In the cut-off voltage generating unit 37, a cut-off voltage inverter circuit 39 generates an AC power signal "c" of 10-100 V at 1-500 kHz in response to a control signal from the control circuit 23. The AC power signal "c" is converted to a cut-off voltage (DC voltage signal) of DC −5 to −100 V by a cut-off voltage isolation transformer 40 and a cut-off voltage boost circuit 41. The primary side of the cut-off voltage isolation transformer 40 is provided with a primary mirror winding to respond to the secondary side output thereof, and the cut-off voltage detection signal is generated from the output of the primary mirror winding through a rectifier circuit 42 for detecting the cut-off voltage.

Likewise, in the grid-voltage generating unit 36, an extraction voltage inverter circuit 43 generates an AC power signal "d" of 10-100 V at 1-500 kHz in response to a control signal from the control circuit 23. The AC power signal "d" is converted to a voltage (DC voltage signal) of DC 1-200 V by an extraction voltage isolation transformer and an extraction voltage boost circuit 45, and the extraction voltage is generated by superimposing the converted voltage on the cut-off voltage. That is, when no extraction voltage is generated, the grid voltage is the cut-off voltage; when the extraction voltage is generated, the grid voltage is obtained by superimposing the extraction voltage on the cut-off voltage. The primary side of the extraction voltage isolation transformer 44 is provided with a primary mirror winding to respond to the secondary side output thereof, and the extraction voltage detection signal is generated from the output of the primary mirror winding through a rectifier circuit 46 for detecting the extraction voltage.

The cut-off voltage detecting unit 38 detects whether the cut-off voltage is generated in accordance with settings, and the generation of radiation is stopped if the cut-off voltage is decreased.

In the filament driver 27, a filament inverter circuit 47 generates an AC power signal "e" of 10-100 V at 1-500 kHz in response to a control signal from the control circuit 23. The AC power signal "e" is converted to a filament voltage (DC voltage signal) of DC 5-10 V by a filament isolation transformer 48 and a full-wave rectifier circuit 49, and the filament voltage is applied to the filament 12. The primary side of the filament isolation transformer 48 is provided with a primary mirror winding to respond to the secondary side output thereof, and the filament voltage detection signal is generated from the output of the primary mirror winding through a rectifier circuit 50 for detecting the filament voltage.

Here, a detection method and a method of dealing with abnormal situations in the cut-off voltage detecting unit 38 are described. If the cut-off voltage decreases, the grid voltage increases more than normal, and electrons more than setting are emitted when radiation is generated, resulting in damage to the target 11.

The cut-off voltage, which is the output of the cut-off voltage generating unit 37, is used as an operating power supply of the cut-off voltage detecting unit 38. The cut-off voltage energizes the coil of a relay circuit (hereinafter referred to just as a "relay") 51, where a coil operating voltage is adapted to the cut-off voltage. Since the cut-off voltage is a negative DC voltage relative to the cathode potential, the output of the cut-off voltage generating unit 37 is input to the negative pole of the coil of the relay 51, and the cathode potential is input to the positive pole of the coil of the relay 51. As the contact output circuit of the relay 51, a normally open circuit is used, which turns on (i.e., conducts) the contact output circuit when the adapted voltage is applied to the coil of the relay. The contact output circuit (switching circuit) is interposed between the lines on one side of the secondary side output of the filament isolation transformer 48. When the output of the cut-off voltage generating unit 37 is normal, the coil of the relay 51 works properly, the contact output circuit of the relay 51 is turned on, and the secondary side output of the filament isolation transformer 48 is transmitted to the full-wave rectifier circuit 49 connected downstream thereof. Thus, the filament driver 27 is operated under normal conditions. On the contrary, if the absolute value of the output of the cut-off voltage generating unit 37 is decreased, the coil of the relay 51 cannot be energized, the contact output circuit of the relay 51 is turned off (becomes non-conductive). The secondary side output of the filament isolation transformer 48 will not be transmitted to the full-wave rectifier circuit 49 connected downstream thereof, and the voltage applied to the filament 12 is cut off. This prevents the cathode from emitting electrons so that the target 11 is not irradiated by electrons.

If a failure occurs in the cut-off voltage boost circuit 41 and its output decreases, the rectifier circuit 42 cannot detect an abnormal cut-off voltage. However, when the contact output circuit of the relay 51 is turned off, the secondary side output of the filament isolation transformer 48 becomes an open circuit. Then the filament voltage detection signal detected via the filament isolation transformer 48 is input to the control circuit 23 as an abnormal signal. The control circuit 23 determines an abnormal filament voltage and transmits abnormality information to a control device 4 of a radiation imaging system described below. The control device 4 can cause a display device 5 to perform an error display corresponding to abnormality information, and can also inhibit the operation of generating radiation and stop application of a tube voltage. Thus, the target 11 is protected by a double protection system.

While the relay 51 is an electromagnetic relay, a mercury relay and a photo MOS relay may be used. Instead of a relay, a switching circuit having, for example, an operational amplifier and a transistor also may be used.

Second Embodiment

Figure 4:
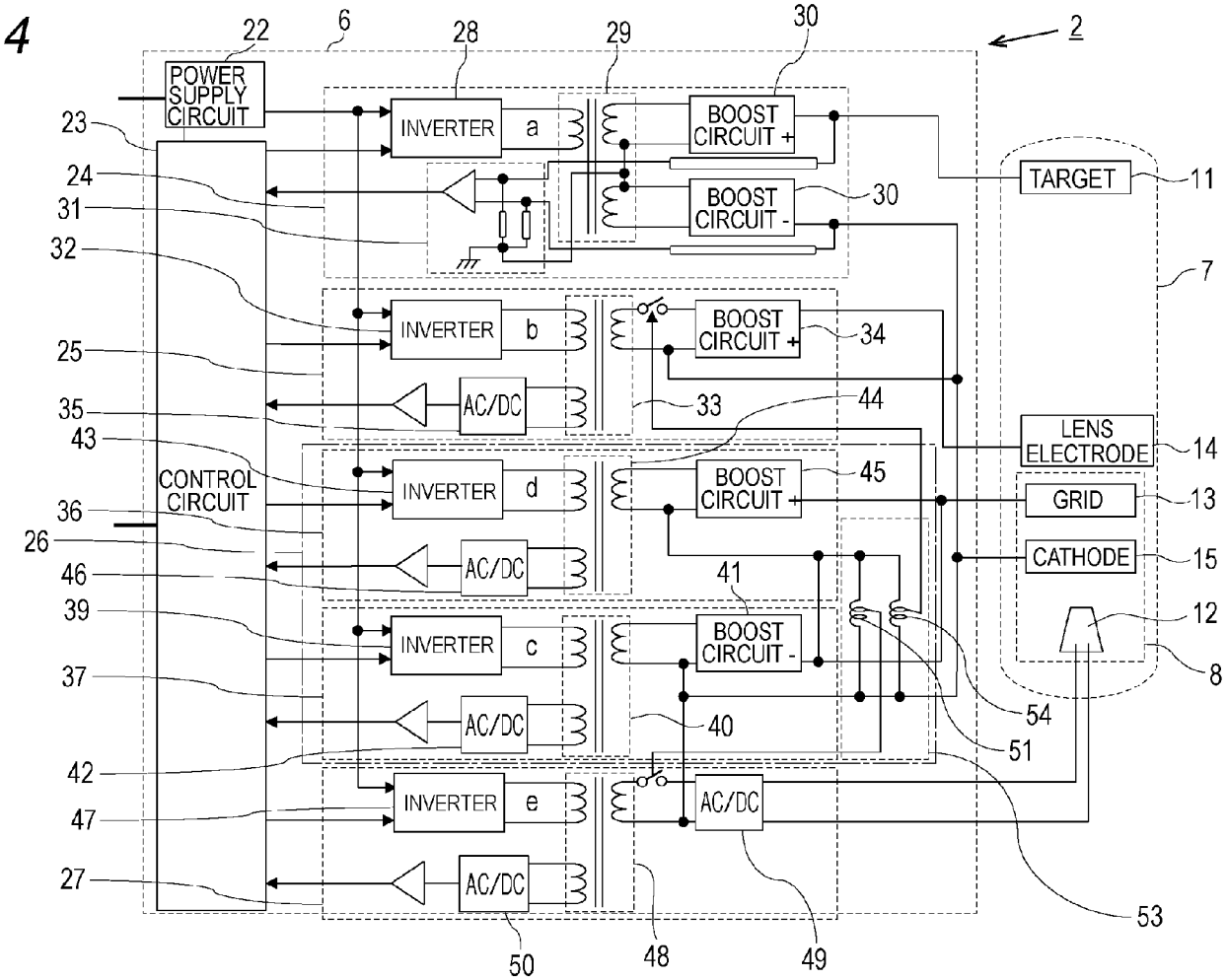
FIG. 4 is a block diagram showing the configuration of a radiation generator according to another embodiment of the present invention.

FIG. 4 is a block diagram showing the configuration of a radiation generator 2 according to another embodiment of the present invention. The configuration of the radiation generator 2 according to the second embodiment, other than a cut-off voltage detecting unit 53, is the same as that of the first embodiment.

The coil of the relay 51 and the coil of the relay 54 having the coil operating voltage adapted to the cut-off voltage are connected in parallel. The cut-off voltage is input to the negative poles of the coil of the relay 51 and the coil of the relay 54, and the cathode potential is input to the positive poles thereof. Both the relay 51 and the relay 54 employ normally open circuits as the contact output circuit. The contact output circuit of the relay 51 is interposed between the lines on one side of the secondary side output of the filament isolation transformer 48. When the cut-off voltage is normal, the coil of the relay 51 works properly, and the contact output circuit of the relay 51 is turned on. Then the secondary side output of the filament isolation transformer 48 is transmitted to the full-wave rectifier circuit 49. Thus, the filament driver 27 is operated under normal conditions. The contact output circuit of the relay 54 is interposed between the lines on one side of the secondary side output of the isolation transformer 33. When the cut-off voltage is normal, the coil of the relay 54 works properly, and the contact output circuit of the relay 54 is turned on. Then the secondary side output of the isolation transformer 33 is transmitted to the boost circuit 34. Thus, the lens electrode driver 25 is operated under normal conditions.

If the cut-off voltage is decreased, the coil of the relay 51 cannot be energized, and the contact output circuit of the relay 51 is turned off. The secondary side output of the filament isolation transformer 48 will not be transmitted to the full-wave rectifier circuit 49, and the desired voltage is not applied to the filament 12.

Likewise, if the cut-off voltage is decreased, the coil of the relay 54 also cannot be energized, and the contact output circuit of the relay 54 is turned off. Thus the secondary side output of the isolation transformer 33 becomes an open circuit, and the lens electrode voltage detection signal detected via the isolation transformer 33 immediately after the lens electrode voltage starts to be applied is input to the control circuit 23 as an abnormal signal. Other operations are the same as the first embodiment.

The present embodiment combines an abnormal filament voltage detection signal and an abnormal lens electrode voltage detection signal, thereby determining an abnormal cut-off voltage. The abnormal cut-off voltage can be complementarily detected even if either relay does not work when the cut-off voltage decreases.

Third Embodiment

Figure 5:
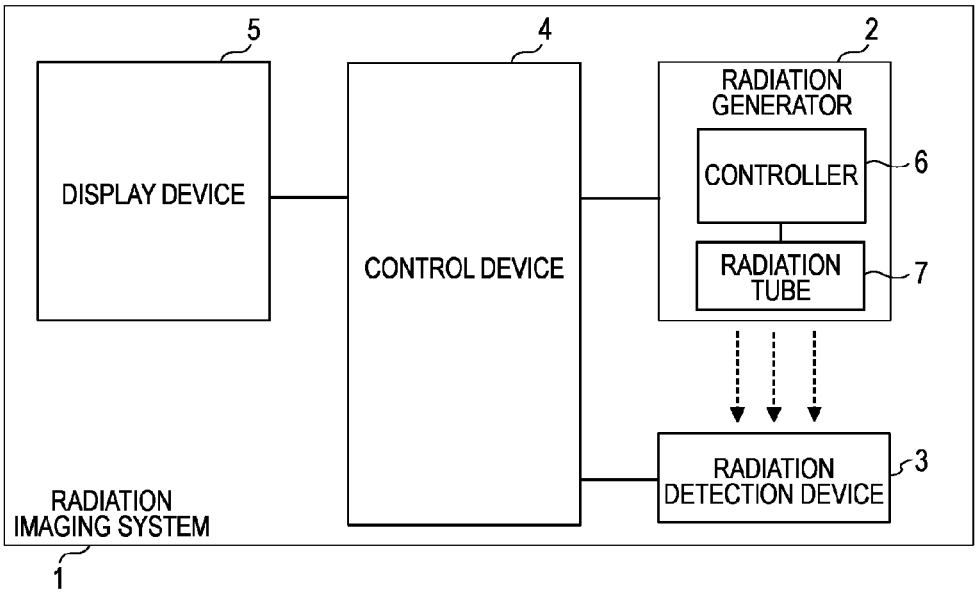
FIG. 5 is a block diagram showing the configuration of a radiation imaging system including the radiation generator according to the present invention.

FIG. 5 is a block diagram of a radiation imaging system 1 according to the present invention. The radiation imaging system 1 includes a radiation generator 2, a radiation detection device 3, a control device 4, and a display device 5 (or user interface).

The control device 4 cooperatively controls the radiation generator 2 and the radiation detection device 3. The radiation generator 2 is that described in the first or second embodiment. A controller 6 is controlled by the control device 4 to output various control signals to a radiation tube 7. A control signal controls the emitting state of radiation from the radiation generator 2. The radiation emitted from the radiation generator 2 is transmitted through a subject (not shown) and is detected by the radiation detection device 3. The radiation detection device 3 converts the detected radiation to an image signal to output it to the control device 4. The control device 4 outputs a signal to display an image on a display device 5 based on the image signal to the display device 5. The display device 5 displays the image based on the signal on a screen as a captured image of the subject.

Although a transmission-type radiation generator has been described in the embodiments above, the embodiments of the present invention are also applicable to a reflection-type radiation generator.

The radiation generator disclosed in accordance with embodiments of the present invention can stop emitting electrons to a target in response to an abnormal output of a cut-off voltage. Consequently, the radiation generator disclosed in accordance with embodiments of present invention can avoid damage to the target due to the failure of the cut-off voltage output, thereby also avoiding shortening the life of a radiation tube.

While the embodiments of present invention have been described with reference to exemplary apparatuses and scenarios, it is to be understood that the embodiments are not limiting. The scope of the following claims is to be accorded the broadest reasonable interpretation so as to encompass all modifications and equivalent structures and functions, as would be understood by a person having ordinary skill in the art.

This application claims the benefit of Japanese Patent Application No. 2012-259900, filed Nov. 28, 2012, which is hereby incorporated by reference herein in its entirety.

What is claimed is:

1. A radiation generator comprising:

a radiation tube including:

a cathode heater configured to generate heat in response to a voltage being applied thereto, an electron emitting cathode configured to emit electrons in response to the heat generated by the cathode heater, a grid electrode configured to control an amount of electrons emitted from the electron emitting cathode, a lens electrode configured to focus an electron beam passing through the grid electrode, and an anode having a target configured to generate radiation in response to an electron irradiation from the electron emitting cathode;

a grid-voltage generating unit configured to apply an extraction voltage to the grid electrode in response to an external request for radiation output;

a cathode heater driver configured to generate a cathode heater voltage;

a cut-off voltage generating unit configured to generate a cut-off voltage applied to the grid electrode so as to lower the potential of the grid electrode relative to the potential of the electron emitting cathode when there is no external request for the radiation output;

a lens electrode driver configured to generate a lens electrode voltage applied to the lens electrode; and a detection unit including a primary switching circuit and a secondary switching circuit, the primary switching circuit configured to turn off energizing to the cathode heater and configured to detect a decrease in the cut-off voltage with respect to the electron emitting cathode, and the secondary switching circuit configured to turn off energizing to the lens electrode, wherein, when the decrease in the cut-off voltage is detected, the primary switching circuit turns off energizing to the cathode heater such that the target is not irradiated by the electrons.

2. The radiation generator according to claim 1, further comprising:

a control circuit configured to control the grid-voltage generating unit, the cut-off voltage generating unit, and the cathode heater driver, wherein the cathode heater driver generates a cathode heater voltage detection signal based on the cathode heater voltage, and the cathode heater voltage detection signal is input to the control circuit.

3. The radiation generator according to claim 2, wherein the control circuit transmits abnormality information to the outside when the control circuit detects an abnormal cathode heater voltage detection signal.

4. The radiation generator according to claim 1, wherein the detection unit includes a relay circuit.

5. The radiation generator according to claim 1, wherein an acceleration voltage starts to be applied between the electron emitting cathode and the target in response to a power-on signal of a power supply circuit, the lens electrode voltage starts to be applied in response to the external request for radiation output after the acceleration voltage starts to be applied, and the extraction voltage starts to be applied after the lens electrode voltage starts to be applied.

6. The radiation generator according to claim 1, further comprising:

a high-voltage generating unit configured to generate an acceleration voltage to be applied between the electron emitting cathode and the target, wherein each of the high-voltage generating unit, the lens electrode driver, the grid-voltage generating unit, and the cut-off voltage generating unit includes an inverter circuit configured to generate an AC power signal from the output of the power supply circuit, and a transformer circuit and a boost circuit configured to convert the AC power signal to a DC voltage signal having a predetermined DC voltage level.

7. A radiography system comprising:

a radiation generator according to claim 1;

a radiation detection device configured to detect radiation that is emitted from the radiation generator and is transmitted through a subject; and a control device configured to control the radiation generator and the radiation detection device.

8. The radiography system according to claim 7, wherein the radiation generator transmits abnormality information to the control device when a decrease in the cut-off voltage is detected, and the control device causes a display device to perform an error display corresponding to the abnormality information from the radiation generator.

9. The radiation generator according to claim 6, wherein the primary switching circuit is electrically intervened between a higher voltage side winding of the transformer circuit and the boost circuit in the cathode heater driver, and the secondary switching circuit is electrically intervened between a higher voltage side winding of the transformer circuit and the boost circuit in the lens electrode driver.

* * * * *